US010204474B2

(12) United States Patent
Arnone et al.

(10) Patent No.: US 10,204,474 B2
(45) **Date of Patent: *Feb. 12, 2019**

(54) COLLECTIVE ENABLING ELEMENTS FOR ENRICHED GAME PLAY ENVIRONMENT (SINGLE AND/OR MULTIPLAYER) FOR CASINO APPLICATIONS

(71) Applicant: Gamblit Gaming, LLC, Glendale, CA (US)

(72) Inventors: Miles Arnone, Sherborn, MA (US); Eric Meyerhofer, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/465,521

(22) Filed: Mar. 21, 2017

(65) Prior Publication Data

US 2017/0206735 A1 Jul. 20, 2017

Related U.S. Application Data

(63) Continuation of application No. 14/642,623, filed on Mar. 9, 2015, which is a continuation of application (Continued)

(51) Int. Cl.
*G07F 17/32* (2006.01)

(52) U.S. Cl.
CPC ..... *G07F 17/3211* (2013.01); *G07F 17/3202* (2013.01); *G07F 17/326* (2013.01); (Continued)

(58) Field of Classification Search
CPC ..... G07F 17/3225; G07F 17/3262; G07F 17/3267; G07F 17/3286; G07F 17/3295; G07F 17/3211
See application file for complete search history.

(56) References Cited

U.S. PATENT DOCUMENTS 5,413,357 A 5/1995 Schulze et al.
5,718,429 A 2/1998 Keller
(Continued)

FOREIGN PATENT DOCUMENTS

JP 2001300098 A 10/2001
JP 2003111980 A 4/2003
(Continued)

OTHER PUBLICATIONS

Itl.nist.gov, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.
(Continued)

*Primary Examiner* — Jasson Yoo
(74) *Attorney, Agent, or Firm* — Frank Cire

(57) ABSTRACT

An electronic gambling game machine constructed to provide a multi-player cooperative skill based entertainment game, played by a plurality of players; receive player input; and determine accumulation of a collective element resulting from the player input from the one or more of the plurality of players, the collective element being available for use by the plurality of players; a game world controller constructed to: receive data regarding the accumulation of the collective element; trigger execution of a gambling game by a real world controller based on the accumulation of the collective element; and distribute to the plurality of players, a gambling outcome of credit of the gambling game generated by the real world controller.

8 Claims, 7 Drawing Sheets

Related U.S. Application Data

No. 14/263,988, filed on Apr. 28, 2014, now Pat. No. 8,974,294, which is a continuation of application No. 13/903,895, filed on May 28, 2013, now Pat. No. 8,708,808, which is a continuation of application No. PCT/US2012/052582, filed on Aug. 27, 2012.

(60) Provisional application No. 61/575,710, filed on Aug. 26, 2011, provisional application No. 61/629,032, filed on Nov. 10, 2011.

(52) U.S. Cl.
CPC ..... *G07F 17/3225* (2013.01); *G07F 17/3255* (2013.01); *G07F 17/3262* (2013.01); *G07F 17/3267* (2013.01); *G07F 17/3272* (2013.01); *G07F 17/3274* (2013.01); *G07F 17/3279* (2013.01); *G07F 17/3295* (2013.01)

(56) References Cited

U.S. PATENT DOCUMENTS 5,785,592 A 7/1998 Jacobsen
5,853,324 A 12/1998 Kami et al.
5,963,745 A 10/1999 Collins et al.
6,050,895 A 4/2000 Luciano
6,165,071 A 12/2000 Weiss
6,227,974 B1 5/2001 Eilat
6,267,669 B1 7/2001 Luciano
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,430,735 B2 4/2013 Oberberger
8,475,266 B2 7/2013 Arnone
8,480,470 B2 7/2013 Napolitano et al.
8,622,809 B1 1/2014 Arora et al.
8,708,808 B2 * 4/2014 Arnone ..... G07F 17/3262 463/1
8,864,564 B2 10/2014 Oberberger
8,974,294 B2 * 3/2015 Arnone ..... G07F 17/3262 463/1
9,070,257 B1 6/2015 Scalise
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0097610 A1 5/2004 Saito
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow

(56) References Cited

U.S. PATENT DOCUMENTS

2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1* 5/2008 Baerlocher ..... G07F 17/32 463/42
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0239610 A1 9/2009 Olive
2009/0247272 A1 10/2009 Abe
2009/0270164 A1 10/2009 Seelig
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0285869 A1 11/2010 Walker
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0070945 A1 3/2011 Walker
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0201413 A1 8/2011 Oberberger
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0135793 A1 5/2012 Antonopoulos
2012/0202587 A1 8/2012 Allen
2012/0302311 A1 11/2012 Luciano
2012/0322545 A1 12/2012 Arnone et al.
2013/0029760 A1 1/2013 Wicket
2013/0131848 A1 5/2013 Arnone et al.
2013/0190074 A1 7/2013 Arnone et al.
2013/0260869 A1 10/2013 Leandro et al.
2014/0087801 A1 3/2014 Nicely et al.
2014/0087808 A1 3/2014 Leandro et al.
2014/0087809 A1 3/2014 Leupp et al.
2014/0357350 A1 12/2014 Weingardt et al.

FOREIGN PATENT DOCUMENTS

JP 2004097610 A 4/2004
JP 2004166746 A 6/2004
JP 2008-510525 4/2008
JP 2008-119469 5/2008
WO 9851384 11/1998
WO 9851384 A1 11/1998
WO 2010087090 A1 8/2010
WO 2011109454 A1 9/2011
WO 2012139083 A1 10/2012
WO 2013059308 A1 4/2013

OTHER PUBLICATIONS

Changing the Virtual Self: Avatar Transformations in Popular Games; Barr et al., Victoria Univ., NZ, 2006.
Real-Time Multimodal Human-Avatar Interaction; Li et al., IEEE (Video Technology) vol. 18, No. 4, 2008.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.

(56) References Cited

OTHER PUBLICATIONS

U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 131686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/799,481 Arnone, et al. filed Jul. 14, 2015.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/604,629 Arnone, et al. filed Jan. 23, 2015.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 141984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
U.S. Appl. No. 15/063,365 Arnone, et al. filed Mar. 7, 2016.
U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.

(56) References Cited

OTHER PUBLICATIONS

U.S. Appl. No. 15/158,530 Arnone, et al. filed May 18, 2016.
U.S. Appl. No. 15/161,174 Arnone, et al. filed May 20, 2016.
U.S. Appl. No. 15/170,773 Arnone, et al. filed Jun. 1, 2016.
U.S. Appl. No. 15/174,995 Arnone, et al. filed Jun. 6, 2016.
U.S. Appl. No. 15/179,940 Arnone, et al. filed Jun. 10, 2016.
U.S. Appl. No. 15/189,797 Arnone, et al. filed Jun. 22, 2016.
U.S. Appl. No. 15/190,745 Arnone, et al. filed Jun. 23, 2016.
U.S. Appl. No. 15/191,050 Arnone, et al. filed Jun. 23, 2016.
U.S. Appl. No. 15/219,257 Arnone, et al. filed Jul. 25, 2016.
U.S. Appl. No. 15/227,881 Arnone, et al. filed Aug. 3, 2016.
U.S. Appl. No. 15/241,683 Arnone, et al. filed Aug. 19, 2016.
U.S. Appl. No. 15/245,040 Arnone, et al. filed Aug. 23, 2016.
U.S. Appl. No. 15/233,294 Arnone, et al. filed Aug. 24, 2016.
U.S. Appl. No. 15/252,190 Arnone, et al. filed Aug. 30, 2016.
U.S. Appl. No. 15/255,789 Arnone, et al. filed Sep. 2, 2016.
U.S. Appl. No. 15/261,858 Arnone, et al. filed Sep. 9, 2016.
U.S. Appl. No. 15/264,521 Arnone, et al. filed Sep. 13, 2016.
U.S. Appl. No. 15/264,557 Arnone, et al. filed Sep. 13, 2016.
U.S. Appl. No. 15/271,214 Arnone, et al. filed Sep. 20, 2016.
U.S. Appl. No. 15/272,318 Arnone, et al. filed Sep. 21, 2016.
U.S. Appl. No. 15/273,260 Arnone, et al. filed Sep. 22, 2016.
U.S. Appl. No. 15/276,469 Arnone, et al. filed Sep. 26, 2016.
U.S. Appl. No. 15/280,255 Arnone, et al. filed Sep. 29, 2016.
U.S. Appl. No. 15/286,922 Arnone, et al. filed Oct. 6, 2016.
U.S. Appl. No. 15/287,129 Arnone, et al. filed Oct. 6, 2016.
U.S. Appl. No. 15/289,648 Arnone, et al. filed Oct. 10, 2016.
U.S. Appl. No. 15/297,019 Arnone, et al. filed Oct. 18, 2016.
U.S. Appl. No. 15/298,533 Arnone, et al. filed Oct. 20, 2016.
U.S. Appl. No. 15/336,696 Arnone, et al. filed Oct. 27, 2016.
U.S. Appl. No. 15/339,898 Arnone, et al. filed Oct. 31, 2016.
U.S. Appl. No. 15/345,451 Arnone, et al. filed Nov. 7, 2016.
U.S. Appl. No. 15/362,214 Arnone, et al. filed Nov. 28, 2016.
U.S. Appl. No. 15/362,660 Arnone, et al. filed Nov. 28, 2016.
U.S. Appl. No. 15/365,628 Arnone, et al. filed Nov. 30, 2016.
U.S. Appl. No. 15/367,541 Arnone, et al. filed Dec. 2, 2016.
U.S. Appl. No. 15/369,394 Arnone, et al. filed Dec. 5, 2016.
U.S. Appl. No. 15/370,425 Arnone, et al. filed Dec. 6, 2016.
U.S. Appl. No. 15/375,711 Arnone, et al. filed Dec. 12, 2016.
U.S. Appl. No. 15/387,117 Arnone, et al. filed Dec. 21, 2016.
U.S. Appl. No. 15/392,887 Arnone, et al. filed Dec. 28, 2016.
U.S. Appl. No. 15/393,212 Arnone, et al. filed Dec. 28, 2016.
U.S. Appl. No. 15/394,257 Arnone, et al. filed Dec. 29, 2016.
U.S. Appl. No. 15/396,352 Arnone, et al. filed Dec. 30, 2016.
U.S. Appl. No. 15/396,354 Arnone, et al. filed Dec. 30, 2016.
U.S. Appl. No. 15/396,365 Arnone, et al. filed Dec. 30, 2016.
U.S. Appl. No. 15/406,474 Arnone, et al. filed Jan. 13, 2017.
U.S. Appl. No. 15/413,322 Arnone, et al. filed Jan. 23, 2017.
U.S. Appl. No. 15/415,833 Arnone, et al. filed Jan. 25, 2017.
U.S. Appl. No. 15/417,030 Arnone, et al. filed Jan. 26, 2017.
U.S. Appl. No. 15/422,453 Arnone, et al. filed Feb. 1, 2017.
U.S. Appl. No. 15/431,631 Arnone, et al. filed Feb. 13, 2017.
U.S. Appl. No. 15/434,843 Arnone, et al. filed Feb. 16, 2017.
U.S. Appl. No. 15/439,499 Arnone, et al. filed Feb. 22, 2017.
U.S. Appl. No. 15/449,249 Arnone, et al. filed Mar. 3, 2017.
U.S. Appl. No. 15/449,256 Arnone, et al. filed Mar. 3, 2017.
U.S. Appl. No. 15/450,287 Arnone, et al. filed Mar. 6, 2017.
WIPO/ISA International Search Report and Written Opinion, PCT/US2012/052582, dated Nov. 13, 2012.
WIPO/IPEA International Preliminary Report on Patentability, PCT/US12/52582, dated Sep. 13, 2013.
Japan Patent Office, First Office Action, Japan Patent Application No. 2014-527358, dated Sep. 22, 2014, Japan.
U.S. Appl. No. 14/205,303 Arnone, et al., filed Mar. 11, 2014.
U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/617,852 Arnone, et al. filed Feb. 9, 2015.
U.S. Appl. No. 14/625,475 Arnone, et al. filed Feb. 18, 2015.

* cited by examiner

COLLECTIVE ENABLING ELEMENTS FOR ENRICHED GAME PLAY ENVIRONMENT (SINGLE AND/OR MULTIPLAYER) FOR CASINO APPLICATIONS

CROSS REFERENCE TO RELATED APPLICATIONS

The current application is a continuation of U.S. patent application Ser. No. 14/642,623 filed on Mar. 9, 2015, which is a continuation of U.S. patent application Ser. No. 14/263,988 filed on Apr. 28, 2014 and issued as U.S. Pat. No. 8,974,294 on Mar. 10, 2015, which is a continuation of U.S. patent application Ser. No. 13/903,895 filed on May 28, 2013, and issued as U.S. patent Ser. No. 13/903,895 and issued on Apr. 29, 2014, which is a continuation of Patent Cooperation Treaty Application No. PCT/US12/52582, filed Aug. 27, 2012, which claims the benefit of U.S. Provisional Application Nos. 61/575,710, filed Aug. 26, 2011, and 61/629,032, filed Nov. 10, 2011, and is related to PCT patent application PCT/US11/26768, filed Mar. 1, 2011, U.S. Provisional Patent Application No. 61/459,131, filed Dec. 6, 2010, U.S. Provisional Patent Application 61/460,362, filed Dec. 31, 2010, and U.S. Provisional Patent Application No. 61/574,753, filed on Aug. 9, 2011 entitled, "VARIOUS CONTROL ELEMENTS IN A HYBRID GAME", the contents of each of which are hereby incorporated by reference as if stated in full herein.

BACKGROUND

Field

Various embodiments of the present invention relate generally to a game of chance and more specifically to the methods and apparatus to create and operate the hardware and software constituent components in the context of a game of chance environment.

Background

The gaming machine manufacturing industry provides a variety of gaming machines for the amusement of gambling players. An exemplary gaming machine is a slot machine. A slot machine is an electro-mechanical game wherein a random number generator determines the outcome of a gambling game, and this, coupled with the betting decisions of a player, results in a specific payout. Slot machines are usually found in casinos or other more informal gaming establishments.

Slot machines have a simple implementation of a game of chance wherein a player of the slot machine provides credits that the player wagers by manipulation of the slot machine's various buttons, levers, etc. The slot machine takes the wager and calculates a result that is then presented to the player via an electromechanical or video display.

Games involving random outcomes for gambling games and games having a player skill component have been combined. For example, U.S. Patent Application Publication No. 2005/0239538 A1 discloses a gaming apparatus that includes a video game unit, a gambling game unit and a game interface unit. The game interface unit controls the playing of the video game unit based on the playing of the gambling game unit. The gaming apparatus is further configured to pay winnings to a player playing the gaming apparatus based on signals from the game interface unit.

U.S. Patent Application Publication No. 2008/0108425 A1 discloses a gaming device that enables players to play an interactive game and make wager components that occur during the interactive game, where the wagering outcome for each of the wager components is independent from the interactive game. The interactive game is a skill based game initiated by the player. The player funds the gaming machine and during play of the interactive game, upon the occurrence of a wager triggering event, the gaming machine causes a wagering event to occur. The wagering event includes a placement of a wager component and a random determination of a wagering outcome for that wagering event.

U.S. Patent Application Publication No. 2010/0056247 A1 discloses a gaming device that includes a game or game event having an element of strategic skill. The game or game event enables a player to make strategic choices or decisions that have a direct impact on the player's chance of obtaining one or more outcomes or awards in a play of a game.

U.S. Pat. No. 7,326,115 discloses a gaming machine having a first interactive game requiring one or more player inputs. The player inputs result in one or more outcomes. The outcomes do not result in a monetary or other valuable award provided to the player. Rather, a second wagering game is always provided to the player where the player can obtain or has a chance to obtain a monetary or other valuable award.

U.S. Patent Application Publication No. 2009/247272 discloses a gaming machine having a display which arranges a plurality of symbols in a matrix of arrangement areas. The gaming machine provides a base game and a plurality of feature games using the display by rearranging the plurality of symbols in the arrangement areas in the base game, awards a base payout in accordance with a relation among the symbols rearranged in the arrangement areas, awards a feature game which corresponds to the number of predetermined symbols rearranged in the arrangement areas, performs the feature game and awards a bonus payout in accordance with a result of the feature game.

U.S. Pat. No. 5,718,429 discloses a game in which people may place a stake in a casino game and win a cash prize in a skill game. Stakes in the casino game are placed with chips, which may be purchased in exchange for the services of conducting the casino game. A winning stake is rewarded with a token, rather than with money. A token may be exchanged for an opportunity to demonstrate a skill in the skill game. Those that successfully demonstrate the skill are awarded cash or other prize.

U.S. Pat. No. 5,785,592 discloses an interactive target game system for one or more players which may include a vehicle on which a player may ride over a predetermined pathway in a defined area (or the player may walk.) The game includes at least one designator, holdable by a player for aiming at a target and operating to simulate shooting at the target, and at least one target disposed in proximity to the pathway. An indicator device responds to the designator being accurately aimed at the target and operated, for producing an indication of a "hit" or score. The targets may include opportunities to play a game of chance.

U.S. Patent Application Publication No. 2004/0121839 discloses a gaming apparatus operable by a player to simulate a card game in which a hand of cards is dealt to the player. The gaming apparatus displays an image of a player hand including at least one obscured card when first dealt, and modifies the display image data in accordance with player instructions received by the input means, to cause the created image to reveal each obscured card in a manner determined by the player.

SUMMARY

Various embodiments of the present invention are a form of a gaming machine, designed for use in a physical or virtual casino environment, which provides players an environment in which to play for cash, either against the casino and/or each other in a regulated manner, in a fashion mimicking video entertainment games which are popular today (such as those executing on a PlayStation® or Xbox® and including multi-player and massively multi-player games played over the Internet).

Many embodiments provide an enticing method of gaming to the players who expect a high level of entertainment content in their gaming experience compared to the relatively simple game methods in use today. In some embodiments, a method is provided for a random outcome independent of player skill while ensuring that the user's gaming experience (as measured by obstacles/challenges encountered, time of play and other factors) is shaped by the player's skill. In numerous embodiments, the method also provides for players to gain entry into subsequent competitions through the accumulation of "game world credits" that accrue as a function of their demonstrated skill at the game. These competitions, the inclusion of which is not a mandatory component of the invention's implementation, would pit individual players or group of players against one another and/or against the casino to win prizes based upon a combination of chance and skill. These competitions may be either asynchronous events, whereby players participate at a time and/or place of their choosing, or they may be synchronized events, whereby players participate at a specific time and/or venue.

In various embodiments, in a typical gaming environment application, these games are installed and connected by a network on a casino floor, and/or be connected by various means to a wide area network to a server conglomeration which would control various aspects of the gaming environment, provide gaming regulatory body monitoring, financial accounting and forms of frequent player monitoring for marketing purposes.

An embodiment includes an electronic gambling game machine for processing a collective bet in a hybrid game having an entertainment game and a gambling game, the electronic gambling game machine comprising: a real world controller connected to a game world controller, the real world controller comprising: a credit meter; a random number generator; and a credit paytable, wherein the real world controller is constructed to: receive credit; receive, from the game world controller, a wager trigger; and determine a gambling outcome for a wager of credit using the random number generator and the credit paytable in accordance with a gambling proposition of the gambling game using the trigger; an entertainment software controller connected to the game world controller by a network, the entertainment software controller constructed to: provide a multi-player cooperative skill based entertainment game, played by a plurality of players; receive player input from one or more of the plurality of players for the multi-player cooperative skill based entertainment game; determine accumulation of a collective element of the multi-player cooperative skill based entertainment game resulting from the player input from the one or more of the plurality of players, wherein the collective element is available for use by the plurality of players of the skill based entertainment game during play of the multi-player cooperative skill based entertainment game; communicate, to the game world controller, the actions taken by the plurality of players in the context of the multi-player cooperative skill based entertainment game; a display screen constructed to display, to the one or more of the plurality of players, the available collective elements; a user input device constructed to receive, from the one or more of the plurality of players, a selection of an icon on the display to initiate use of the available collective elements; and the game world controller connected to the real world controller and the entertainment software controller, wherein the game world controller is constructed to: distribute, to the entertainment software controller, the available collective elements to be presented to the one or more of the plurality of players; receive, from the entertainment software controller, player input from the one or more of the plurality of players for the multi-player cooperative skill based entertainment game; trigger the wager of credits in the real world controller based on the accumulation of the collective element of the skill based entertainment game; distribute to the plurality of players of the skill based entertainment game, the gambling outcome of credit generated by the real world controller; and update a state of the multi-player cooperative skill based entertainment game based on the gambling outcome of credit.

In a further embodiment, the network is a local area network.

In another embodiment, the accumulation of the collective element includes accumulation of a collective enabling element, wherein the collective enabling element is an element of the multi-player cooperative skill based entertainment game used by one or more of the plurality of players during play of the skill based entertainment game, and wherein the game world controller is further constructed to: determine use of the collective enabling element by the one or more of the plurality of players; and distribute, to the real world controller, a trigger of the gambling game based on the use of the collective enabling element.

In some embodiments, the accumulation of the collective element includes accumulation of a collective actionable element, wherein the collective actionable element is an element of the multi-player cooperative skill based entertainment game acted upon by one or more of the plurality of players during play of the skill based entertainment game, and wherein the game world controller is further constructed to: determine that the collective actionable element was acted upon by the one or more of the plurality of players; and distribute, to the real world controller, a trigger of the gambling game based on the action upon the collective actionable element of the multi-player cooperative skill based entertainment game.

In other embodiments, an amount of a wager made in the gambling game is allocated from each of the plurality of players based on each player's use of the collective element.

In another embodiment, the credit is a currency fungible instrument.

In another embodiment, the credit is a game world credit.

In some embodiments, the game world controller and the real world controller are constructed from the same device.

DETAILED DESCRIPTION

Methods and systems for a game of a chance, influenced by components of the player's skill, allowing a player to compete directly with a gaming machine device are provided. The methods and systems provide players a rich (i.e. akin to leading home- and arcade-based video games) single-player, multi-player cooperative and/or head to head environment in which the participant(s) win cash and credits as a result of their play activity within the environment, based on the wagers which they make entering and playing the game.

Figure 1:
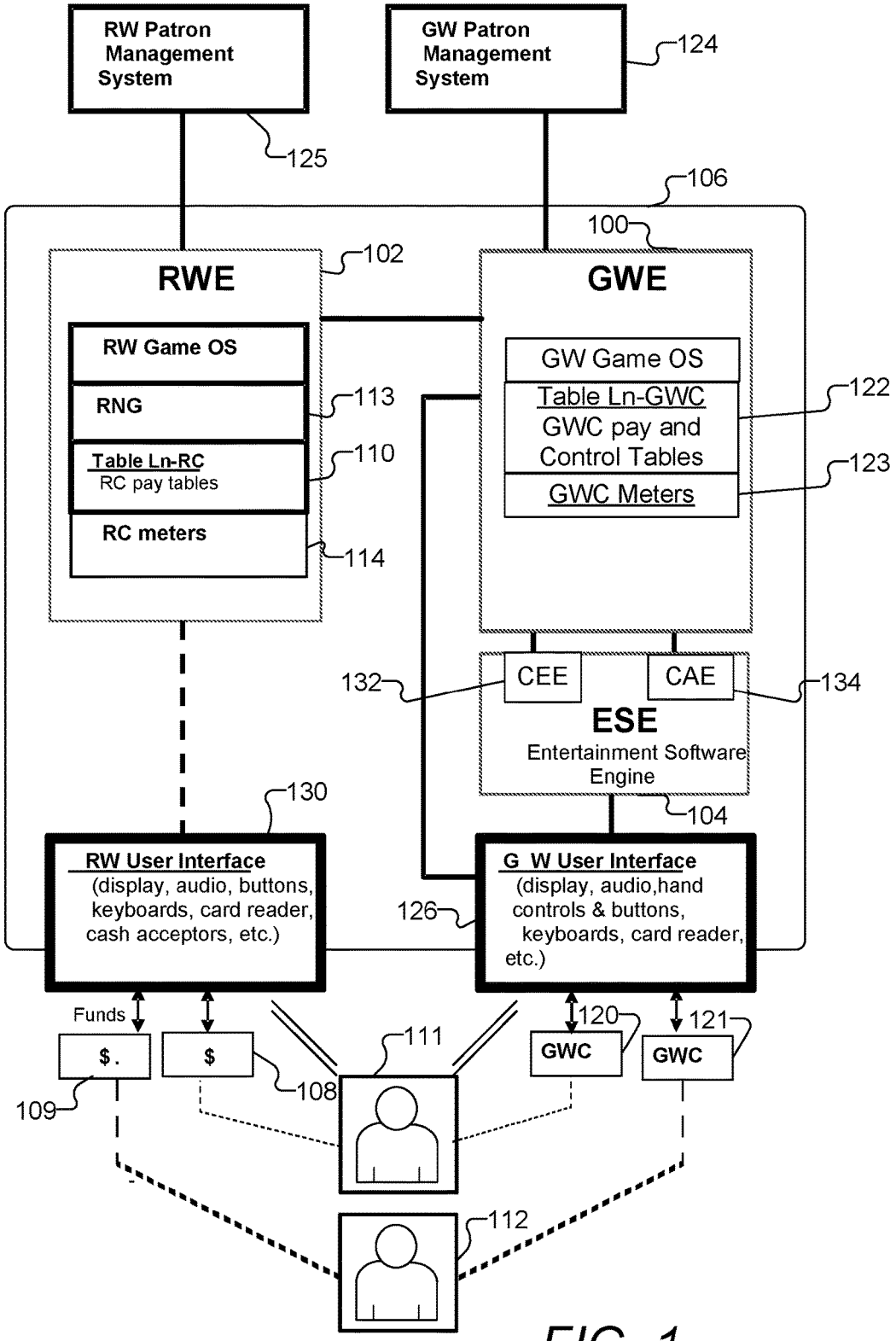
FIG. 1 is a diagram of a gaming system in accordance with exemplary embodiments.

FIG. 1 is a diagram of a gaming system in accordance with exemplary embodiments. FIG. 1 generally illustrates the architecture of the system and the interaction between three systems: a game world engine (GWE) 100, a real world engine (RWE) 102 and an entertainment software engine (ESE) 104. The ESE 104 may include the electrical and software system which controls the playing of video games. The combination of an RWE, a GWE and an ESE are included in a hybrid game 106.

In many embodiments, a game world (GW) includes an entertainment game portion of a hybrid game and includes the information typically associated with a virtual interactive entertainment environment, including its game controlled entities or player characters, progress points and scores. For example, a typical game played on a Sony PlayStation® console could be thought of as being included in a GW.

A real world (RW) portion of a hybrid game is a gambling game portion, which may or may not include an entertainment portion of its own, but whose operation is enabled by real funds, accretes and declinates real gambling credits based on random gambling outcomes, and whose gambling proposition is typically regulated by gaming control bodies. For example, the fundamentals of the mechanisms of play of a slot machine could be thought of as included in a RW.

In some embodiments, real world credit (RC) 108 and 109 are credits that are analogous to slot machine game credits which are entered into a RW game by the user, either in the form of currency or electronic funds. In many embodiments, RCs are decremented or augmented based on the outcome of a random number generator according to a Table Ln-Rc 110 real world credits pay table, independently of player skill. In numerous embodiments, a certain amount of RC are required to enter higher ESE 104 game levels. In some embodiments, RC can be carried forward to higher game levels or paid out if a game cash out is opted for by one or more players, such as players 111 and 112. The amount of RC required to enter a specific level of the game "Level n" need not be the same for each level.

A level n real-world credit pay table (Table Ln-Rc) 110 is a table and/or algorithms that may be included in the RWE 102, and may be used in conjunction with a random, or pseudo random, number generator (RNG) 112 to determine the RC earned as a function of game play and is analogous to the pay tables used in a conventional slot machine. In many embodiments, Table Ln-Rc payouts are independent of player skill. There may be one or a plurality of Table Ln-Rc pay tables included in a game design.

The RWE 102 is the operating system for the RW portion of the game and controls and operates the gambling proposition. The RWE is a portion of a hybrid game which manages the RW portion of the game and may include the mechanical, electronic and software components to: (a) provide control of the RW portion of the game, (b) include Table Ln-RC and to take input from this table to affect the play of the RW portion of the game, (c) couple to the GWE to communicate the amount of RC available on the game, (d) communicate other metrics of wagering to the GWE, (e) accept input from the GWE as to the amount of RC in play, (f) accept signaling from the GWE in order to trigger the actual execution of an RW gambling play, (g) include various audit logs and activity meters, (h) couple to a centralized server, such as RW patron management system 125, for exchanging various data related to accounting of the gambling proposition, the player and their wagering activities on the game.

The RWE includes an RNG 113 which is a software and/or hardware implemented algorithm and/or process which is used to generate random outcomes, pay tables (Table Ln-RC) 110, meters 114 and other software constructs used by the game of chance to offer a fair and transparent gaming proposition, and to include the auditable systems and functions for the game to obtain gaming regulatory body approval. The RWE may encompass many components of a slot machine. A slot machine is typically an electro-mechanical game wherein a random number generator determines the chance of outcome of a game, and coupled with the betting decisions of a player, a gambling outcome result. Slot machines are usually found in casinos or other more informal gaming establishments.

In some embodiments, the RWE 102 does not include an entertainment front end. The RWE accepts a trigger to run the gambling proposition in response to actions taken by the player in the GW as conveyed by the ESE 104 to the GWE 100, or as triggered by the GWE based on the GWE's own algorithms, in the background to the overall game from the player's perspective, but would provide information to the GWE to expose the player to certain aspects of the gaming proposition, such as odds, amount of RC in play, amount of RC available, etc. In some embodiments, an RWE accepts modifications in the amount of RC wagered on each individual gambling try, or the number of games per minute the RWE would execute, entrance into a bonus round, and other factors, all the while these factors and the choices from the player's perspective taking a different form than that of a typical slot machine. An example of a varying wager amount that the player would choose might be that they have decided to play with a more powerful controlled entity in the game, or having a more powerful gun, a better car, etc. These choices would increase or decrease the amount wagered per individual RWE gambling game, in the same manner that a standard slot machine player may decide to wager more or less credits for each pull of the handle. The RWE would communicate a number of factors back and forth to the GWE, discussed below, via their interface, such increase/decrease in wager being a function of the player's decision making as to their operational profile in the GW (i.e. power of the controlled entity, gun selection, car choice, etc.). In this manner, the player may be in control of the per game wager amount, with the choice mapping to some parameter or component which is applicable to the GW experience that is the entertainment piece for the game. An example of the RWE operation are a game of chance running, say every 10 seconds, the amount wagered being communicated from the GWE as a function of choices the player makes in the operation profile in the GW such as those cited above.

In some embodiments, the RWE 102 communicates with the players 111 and 112 using respective RW user interface, such as RW user interface 130. The RW interface may include various devices such as a display, audio output, buttons, keyboards, card readers, cash acceptors, etc. The players may use the RW interface to pay for credits using vouchers or currency, receive cashouts of credits, identify themselves to the patron management systems 124 and/or 125, receive an indication of the current level of credits that the players have with the hybrid game, etc.

Game world credits (GWCs), such as GWCs 120 and 121 associated with the players 111 and 112, respectively, are player points earned or depleted as a function of player skill, i.e. as a function of player performance in the context of the game. In many embodiments, GWC is analogous to the "score" in a typical video game. Each game has a scoring criterion, embedded within a Table Ln-GWC 122 that reflects player performance against the goal(s) of the game. In numerous embodiments, GWC can be carried forward from one level of game play to another, and ultimately paid out in various manners such as directly in cash, or indirectly such as earning entrance into a sweepstakes drawing, or earning participation in, or victory in, a tournament with prizes. In some embodiments, GWC may be stored on a player tracking card or in a network-based player tracking system and the GWC is attributed to a specific player.

A level n game world credit pay table (Table Ln-GWC) 122 is a table and/or algorithm that determines the GWC earned as a function of player skill in the nth level of the game. The payouts governed by this table are dependent upon player skill and game play at large and may or may not be coupled to a random number generator.

In some embodiments, GWC determines levels in a game. In numerous embodiments, any player may begin game play at level 1. Entry to level 1 requires loading of RC into the game. There is no GWC required to enter level 1. Players can re-enter the game at level 'n' if they have accumulated adequate GWC to enter the level. A specific GWC hurdle is established for each Level, with GWC>0 allowing entry into level 1. The GWC hurdle for each level n may be the same or can increase as a function of each level. In some embodiments, when a certain level of GWC is obtained by the player, game play proceeds to a non-re-entrant level Level B1 commences a series of levels from B1 to Bn where re-entry is no-longer possible and where game play may be exclusively skill based or a combination of skill and chance. In many embodiments, game-play continues as the player advances through the B levels until such time as the player either cashes out their RC, all RC has been consumed, a player has exhausted their GWC through play, or a player has exhausted their game controlled entity's lives, energy or other element required for the controlled entity to survive within the game environment. In some embodiments, a player cashing out in the B levels can re-enter the game at the highest re-entrant level, "level n". In some embodiments, there are additional levels are non-re-entrant levels that are only accessed by completing a level B(n−1) with adequate GWC.

In some embodiments, an enabling element (EE) is a GW element that is consumed or accumulated in the context of the game, such as ammo, health points, potions, fuel, etc. In numerous embodiments, currency includes EE, GWC, RC, other entertainment game elements.

FIG. 1 also includes the GWE 100, the gaming world operating system. The GWE is a portion of the hybrid game which manages the GW portion of the game and may include the mechanical, electronic and software components to: (a) provide control of the GW portion of the game, (b) include Table Ln-GWC 122 and to take input from this table to affect the play of the GW portion of the game, (c) couple to the RWE 102 to determine the amount of RC available on the game and other metrics of wagering on the RW portion of the game, and potentially affect the amount of RC in play on the RWE, (d) include various audit logs and activity meters 123, (e) couple to a centralized server 124 for exchanging various data related to the player and their activities on the game, (f) couple to the ESE 104.

In many embodiments, one of the GWE's 100 functions is to manage the overall game operation, with the RWE 102 and the ESE 104 effectively being support units to the GWE. In some embodiments, no operation of the GWE affects the RWE's gambling operation except for player choice parameters that are allowable in slot machines today, such as the wager amount, how fast the player wants to play (by pressing a button or pulling the slot's handle), agreement to wager into a bonus round, etc. In this sense, the RWE provides a fair and transparent, non-skill based gambling proposition co-processor to the GWE. The communication link shown between the GWE and the RWE in FIG. 1 is primarily for the purposes of GWE obtaining information from the RWE as to the amount of RC available on the RW portion of the game, and status operation of the RWE (such as on-line or tilt), and for the GWE to communicate to the RWE the various gambling control factors which the RWE uses as input, such as the number of RC consumed per game or the player's election to enter a jackpot round.

In some embodiments, the GWE 100 connects to the player's user interface 126 directly, as this may be used to communicate certain GW club points, player status, control the selection of choices and messages which a player may require in order to adjust their GW experience or understand their gambling status in the RWE 102.

In FIG. 1, the GWE 100 also connects to the ESE 104. The ESE manages and controls the visual, audio and player control entertainment for the GW game. In many embodiments, the ESE accepts input from a player through a set of hand controls and outputs video, audio and/or other sensory output to a user interface. A PC, Nintendo Wii®, Sony PlayStation® or Microsoft Xbox® running a specific game program (e.g. a version of Madden Football '10®) are examples of an ESE. The ESE exchanges data with and accepts control information from the GWE.

The ESE 104 operates mostly independently from the GWE 100, except that via their interface, the GWE may send certain GW game control parameters to the ESE to affect its play, such as what level of controlled entity to be using, changing the difficulty level of the game, changing the type of gun or car in use, requesting potions to become available or to be found by the controlled entity, etc. The ESE accepts this input from the GWE, makes adjustments, and continues the play action all the while running seamlessly from the player's perspective. The ESE's operation is mostly skill based, except for where the ESE's algorithm may inject complexities into the game by chance in its normal operation to create unpredictability in the GW game and the like. Utilizing this interface, the ESE may also communicate player choices made in the game to the GWE, such as selection of a different gun, the player picking up a special potion in the GW environment, etc. The GWE's job in this architecture, being interfaced thusly to the ESE, is to allow the transparent coupling of entertainment software to a fair and transparent random chance gambling game, providing a seamless perspective to the player that they are playing a typical popular entertainment and skill based game. For example, the ESE in this application could be used to enable a wide range of games including popular titles from arcade and home video games (e.g. Gears of War, Time Crisis, Madden Football, etc.). Providers of such software would provide the previously described interface by which the GWE could request amendments to the operation of the ESE software, in order to provide the seamless and sensible operation of the invention as both a RW gambling and entertainment machine.

In numerous embodiments, a video game style gambling machine is implemented, where the gambling portion of the game (i.e. RWE 102 and RC 108 of FIG. 1) is not player skill based, while at the same time allows players to use their skills to earn club points which an operator of a casino, such as an operator of a gaming establishment in either one or a plurality of locations where people go to play a gambling games of chance whether online or land-based, can translate to rewards, tournaments opportunities and prizes for the players. The actual exchange of monetary funds earned or lost directly from gambling against a slot machine is preserved, while at the same time a rich environment of rewards to stimulate "garners" can be established. In some embodiments, a casino operator may operate other gambling operations, including but not limited to a wide area network gaming franchise, a gaming route, or other gambling business be it a physical manifestation in the case of a casino or virtual in the case of an internet gambling operation.

In many embodiments, a hybrid game leverages very popular titles with "gamers" and provides a sea change environment for casinos to attract players with games that are more akin to the type of entertainment which a younger generation desires.

In many embodiments, players use their skill towards building and banking GWC which in turn could be used to win tournaments and various prizes as a function of their "gamers" prowess.

In some embodiments, the underlying changes to the aforementioned entertainment software (Gears of War, etc.), are minimized for the entertainment game to operate within the gaming construct, thus making a plethora of complex game titles and environments, rapid and inexpensive to deploy in a gambling environment.

Various hybrid games are discussed in Patent Cooperation Treaty Application No. PCT/US11/26768, filed Mar. 1, 2011, entitled "ENRICHED GAME PLAY ENVIRONMENT (SINGLE and/or MULTI-PLAYER) FOR CASINO APPLICATIONS" and Patent Cooperation Treaty Application No. PCT/US11/63587, filed Dec. 6, 2011, entitled "ENHANCED SLOT-MACHINE FOR CASINO APPLICATIONS" each disclosure of which is hereby incorporated by reference in its entirety.

In many embodiments of a hybrid game, the functioning of a hybrid game uses enabling elements (EE) and their interoperability with the hybrid game. EEs for a hybrid game are typically some consumable commodity and/or accumulating element in game context to play and operate controlled entities or characters or take actions in the game space of the interactive entertainment game. A non-exhaustive list of examples of EE includes: weapons ammunition, health points in a fighting game, potions in the case of a fantasy game, fuel in the case of a driving game, time in the case of a game where one races against the clock to achieve some objective, armies in the case of a military strategy game, or downs in the case of football. The nature of EE is a function of the type of entertainment game executed on the ESE and its structure. It is contemplated that the consumption of EE in the process of playing the ESE entertainment game would trigger gambling plays on the RWE portion of the hybrid game. In the hybrid game, it is also possible that the events of or acts of accumulation of EE in the entertainment game might also trigger RWE gambling plays in the same manner that consumption of EE would. This is to say that games could use either EE consumption, EE accumulation or both events to trigger RWE wagers. The correlation of what events resulting in the accumulation or consumption of EE might trigger RWE plays, and when, and the amount of RC wagered as a result of these events, would be a function of algorithms and formulae operating within the GWE and the hybrid game. It should be understood that as consistent with hybrid game methods that other triggers for RWE plays other than EE consumption or accumulation could be possible.

In another embodiment, an enabling element (EE) is shared by two or more players. Such an EE, hereafter referred to as a collective enabling element (CEE) 132, can be linked to the initiation of a gambling game in a number of ways. In some embodiments, individual players consume the CEE and trigger gambling games, the result of which (in terms of RC consumption and/or accretion) are linked back expressly to that individual player. In many embodiments, individual players consume CEE and trigger gambling games, the result of which (in terms of RC consumption and/or accretion) are linked back to a common RC pool shared by the participating players. In numerous embodiments, CEE is consumed as a function of coordinated actions undertaken by multiple players. Again the result of this consumption initiates a gambling game or gambling games that can accrue to the individual player or to a common RC pool shared by the participating players. A non-exhaustive list illustrating different consumption and accrual relationships are as follows.

1. In some embodiments, individual players consume CEE, results accrue to individual player's RC and shared CEE
2. In many embodiments, individual players consume CEE, results accrue to group's RC and shared CEE
3. In numerous embodiments, players consume CEE jointly, results accrue to individual player's RC and shared CEE
4. In various embodiments, players consume CEE jointly, results accrue to group's RC and shared CEE An example of case one follows. In a version of an adventure game, a group of players undertake a quest through a haunted forest. The CEE is a stockpile of food carried by a pack animal that the players consume to hold up their individual character's health. A player needs to consume food to enable activity (e.g. walking, fighting) and also in response to injury to maintain or repair his character's body. Each time a player consumes CEE (food) a gambling game results, with the resulting RC and its attendant CEE accruing (or decrementing) to the individual player's RC and CEE accounts. In this example embodiment, players also have food they carry on their person (EE), but once the amount of EE exceeds a certain amount it cannot be carried by the individual and needs to be loaded onto the pack animal. At this point it becomes CEE and can be accessed by all players in the manner described. The conversion of EE into CEE may or may not be accompanied by a transaction that benefits the contributing player (e.g. via GWE accumulation, a partial cash out, possibly at a discounted rate relative to the RC-EE conversion rate, etc.).

An example of case 2 follows. In a version of an adventure game, a group of players undertake a quest through a haunted forest. The CEE is a stockpile of food that the players consume to hold up their individual character's health. A player needs to consume food to enable activity (e.g. walking, fighting) and also in response to injury to maintain or repair his character's body. Each time a player consumes CEE (food) a gambling game results, with the resulting RC and its attendant CEE accruing (or decrementing) to common pools of RC and CEE. When the game ends, the RC in the common pool can be distributed as a function of one of many mechanisms (e.g. as a function of player's contribution to RC, as a function of each player's GWC, a previous agreement made between the players, random distribution within bounded ranges, a head to head wrestling match, or other mechanisms or a combination of multiple mechanisms).

An example of case 3 follows. In a team oriented racing game, players contribute RC (in equal or unequal amounts) to the game to fund gambling games. The sum of these contributions corresponds to a specified amount of CEE. In this example, the CEE is fuel available to the pool of cars on the team. The object of the game is to cross the Sahara desert, and to get team's car across the finish line as quickly as possible without running out of fuel. Individual players undertake different roles—driver, navigator, repair technician, fuel attendant, advance scout, etc. As the game progresses, the team consumes fuel as a function of the decisions made by the players and their effect on the progress of the car. For example, if the navigator chooses a longer route, more fuel will be consumed. If the fuel attendant spills fuel, CEE will be consumed, for example. The consumption of CEE will trigger a gambling game, which, as is typical for a hybrid game will result in the loss or gain of RC, and an attendant change in the amount of CEE. The RC gains or losses will accrue, in this example, to each party as a function of their individual contributions to the RC (and by extension CEE) pool at the onset of game play. The CEE gains or losses as a function of the change in RC will affect the common pool of CEE.

An example of case 4 follows. In a team oriented racing game, players contribute RC (in prescribed equal amounts) to the game to fund gambling games. The sum of these contributions corresponds to a specified amount of CEE. In this example, the CEE is fuel available to the pool of cars on the team. The object of the game is to cross the Sahara desert, and to get team's car across the finish line as quickly as possible without running out of fuel. Individual players undertake different roles—driver, navigator, repair technician, fuel attendant, advance scout, etc. As the game progresses, the team consumes fuel as a function of the decisions made by the players and their effect on the progress of the car. For example, if the navigator chooses a longer route, more fuel will be consumed. If the fuel attendant spills fuel, CEE will be consumed, for example. The consumption of CEE will trigger a gambling game, which, as is typical for a hybrid game will result in the loss or gain of RC, and an attendant change in the amount of CEE. The RC gains or losses will accrue, in this example, to a common pool, which will be divided equally amongst the players at the end of the game. The CEE gains or losses as a function of the change in RC will affect the common pool of CEE.

A broad example in another context would be that of a team shooter game, where players' characters are creatures of a non-human form that work together and share a common life force against a common enemy. In this example, there are two forms of EE, life force points and ammunition. These two commodities are shared in common, in the case of life force points each player's character draws from a common "aura" that provides life for the character, making this a CEE. The characters, being of a communal type, freely share a common pool of ammunition, also making this type of EE, CEE. When engaged in battle, as the character attack, ammunition is immediately consumed as it is used. In this embodiment, the consumption of the CEE would trigger a group gambling game. If one of the character's is injured in play, another character (controlled by a different player) can elect to supercharge the injured character's life force back up through some action in the game construct, but at the direct expense to the charging player's character, and indirectly to all the other character's on the team as the charging character in turn draws life force points from the "aura" replenish itself. In the example, the rate of recharging the charging character (who would then be at a life point deficit) from the aura, might have a different rate than that of the supercharge action cited above. As with ammunition CEE consumption, consumption of the life force points CEE also triggers a gambling play(s). The foregoing caries a meaningful implication, which is to say, that under certain embodiments, the sharing of various types of CEE may not occur at similar rates, but rather some may be effectively real-time and others may have a charge or transfer period, depending on the CEE, the CEE relevance in the game construct at the time, and the game construct itself.

In each of these cases, and in any implementations involving CEE, GWE can be managed on an individual player basis, can be equal for all players cooperating in a game, or can be managed independently of the CEE construct. It should be understood that all of the aspects of the hybrid game that can affect EE, its relationship with RC, and another other EE influencing and outcome effects also apply to CEE.

Another type of element that may be used in the hybrid game construct and its interoperability of credit exchange and deployment is called an actionable element (AE). Like an EE, an AE can initiate a gambling game by committing RC to the gambling proposition within the RWE. Unlike an EE, however, which is consumed or accumulated, an AE may not be expressly consumed or accumulated. AEs, instead, may be tied to specific player decisions or player directed actions that are undertaken in the context of the entertainment game, the outcome of those decisions or actions, or a game event or milestone points, or the transpiring of real or virtual game time in the process of playing the entertainment game. AEs, are constructs within the GW, not the physical world (PW), meaning the actual world with its real people, places, events, etc. The PW could be different than the GW. The PW would include the RW as well. However, AEs, are affected by PW decisions or actions subject to various formulae and algorithms as to whether the PW action or decision causes the AE to transpire.

In various embodiments, there are a number of possible classes and examples of AE, namely:

1. Transpiring of a "meter" in the game space. Some examples being:
   every 10 steps taken by a controlled entity
   10 minutes of game world time (virtual) elapsed
   5 minutes of physical world time elapsed in the physical world
   Walking or traveling past a location or special point
2. GW Controlled Entity decisions directed by the PW player, random. This class of AE is that of decisions made by the GW Controlled Entity in the GW space as directed by the PW player, and are purely random style decision. Each decision in the tree would have some finite chance of success and conversely, failure or have different outcomes. Some examples being:
   Opening one door or another
   Choosing a sailing ship to board Picking up one of three magic rings Choosing a floor on the elevator in an unknown building The decision to throw virtual dice in GW 3. GW Controlled Entity decisions directed by the PW player, knowledge based. This class of AE is that of decisions made by the GW Controlled Entity in the GW space as directed by the PW player, and are based to some degree on knowledge the player may have about the situation or choices. Each decision in the tree would have some finite chance of success and conversely, failure or have different outcomes. Some examples being:

Direct game resources to take a strategic hill or building in a combat game

Selection of a particular airplane to fly. One airplane better than another for the purpose.

Choosing one weapon or another in a 1st person shooter game

Selecting one football player over another when picking a team

Choosing one club over another in a golf game

Selecting one of a number of possible answers to a trivia question in a trivia game.

Submitting an answer—not from a predetermined list of possible answers—to a trivia question in a trivia game The act of drawing a picture on the screen during a player's turn in a Pictionary-like game Selection of a type of troop, armor unit or artillery piece in a war game Selection of a type of armor for a character to wear in a fantasy game The placement of a hotel on a property in a Monopoly game The selection of which property, housing or hotels to mortgage in a Monopoly game when in financial trouble.

4. Actions conducted by the player's GW Controlled Entity in the game space which are impacted by the GW Controlled Entity game characteristics. Some examples being:

Attempting to pick a lock to open a treasure chest in a fantasy game. The success or failure in the attempt being a combination of one or more of the following: a character's dexterity, their strength, their knowledge, an RNG outcome.

Releasing a player's battleship to attack another warship, the success of the battle being a combination of one or more of the following: the battleship's armaments, its ammo, seaplanes and armor rating, an RNG outcome.

5. Outcomes of player directed decisions. Some examples being:

Whether or not a strategic point was taken in a combat game

Whether or not a treasure chest opened after an attempt at picking the lock

Whether or not a character survived the jump from a cliff

Whether or not a plane survived a stunt maneuver

Whether a motorcycle cleared the line of trucks between the jump ramps

Whether or not a fielded football team won the game or not

The outcome of a the virtual dice of a GW dice throw

Whether or not the answer provided to a trivia question was correct

Whether or not the game, or a 3rd party, was able to identify the picture being drawn by the player in a Pictionary-like game within an allowed time frame.

Note that the classes and examples of AE given above are illustrative of various embodiments and are non-exhaustive; the examples intended to serve to illuminate the nature of AE. Other AEs may be possible within the general decision given above.

As stated earlier, each AE or AE outcomes listed above may be capable of triggering a RWE wager of varying RC amounts, and the wager, in some embodiments, also being configured as to the selection of the Table Ln-Rc or other RWE parameters. Various embodiments also subsume the prospect that a free bet may be made available for the player. That is to say, in any of the foregoing examples, a wager of 5 RC (for example), could also be a wager of 5 FPRC. "FPRC" means 5 Free Play Real Credits. The mechanism here is that a player wouldn't be charged for 5 FPRC wager, but such a wager, charged off to the casino or free wager provider, would be placed for the player in the RWE.

The concept of AE also subsumes player directed actions (one action or a chain of actions) that trigger gambling in the context of specific objects within the GW. Some examples being:

A character opens a treasure chest. The treasure chest has associated with it a bonusing round of one type or the other, or a prize, a wager, or a specific gambling game. By virtue of opening the treasure chest, the bonus is awarded, a bonusing round entered or a gambling game initiated, at least one of the outcomes of which is failure (e.g. the chest is empty, the character is killed by a poisoned dart, etc.). The AE in this case is the opening of the chest, which triggers a RWE related event, the context of which is conditioned by the object acted upon, namely the treasure chest.

A player's character seeks and opens a treasure chest after being informed of its existence somewhere in the GW. This example is similar to the above, but includes a more extensive causal chain of events. AE need not be a single action or event.

A player's character drinks a potion. The potion has associated with it a bonusing round of one type or the other, or a prize, a wager, or a specific gambling game. By virtue of drinking the potion, the bonus is awarded, a bonusing round entered or a gambling game initiated, at least one of the outcomes of which is failure (e.g. the character is killed by the potion or loses health points, etc.). The AE in this case is the drinking of the potion, which triggers a RWE related event, the context of which is conditioned by the object acted upon, namely the potion.

A non-exhaustive list of examples of the application of AE would therefore include:

In a 1st person shooter game, reaching a rally point objective (the AE) would cause 5 RC to be bet in a gambling game with certain odds.

In a fantasy game, each time the player's character opens a door (the AE) a wager of 2 RC is initiated.

In a murder mystery game in the proverbial mansion, each 1 hour after midnight of game world time that passes that the character survives (the AE), a 10 RC wager is initiated.

In a maze game, each 10 minutes (the AE) the player uses in navigating the maze results in a 3 RC wager with certain odds.

In a Monopoly Game, each time the player passes GO, (the AE), a 5 RC wager is initiated.

In a travel game, each point of interest reached (the AE) results in a 6 RC wager.

In a Scrabble Game, each time tiles are placed for a word using the player's knowledge resulting in a Double Word score, a 4 RC wager is initiated on a double odds pay table.

In a trivia game, each time the player submits an answer to a question, a 3 RC wager is initiated.

In a Pictionary™-like game, each time the player commences drawing a picture, a 2 RC wager is initiated.

Various embodiments also subsume the concept of collective AE (CAE) 134. Which is to say, a collective form of AE, called CAE, may also be enabled, in a manner similar to CEE. As a collective commodity that can cause accrual and deficit of RC, CAE could apply to collective actions, i.e. the coordinated or uncoordinated actions of a number of players taken as a whole. Any and all relationships between AE and RC, and other AE influencing and outcome effects associated with AE may apply to the concept of CAE.

In many embodiments, CEE and CAE can be deployed in a cooperative mode, as described above, but also in a competitive manner, such that players are not sharing the CEE or CAE, per se, but rather competing against one another to deploy it for the benefit of their own game play. CEE and CAE can therefore represent resources in the game that are required or desired by multiple players, and which convey advantage to the player that consumes, accumulates, or otherwise interacts with them.

For example, in a multi-player combat game, each player contributes RC to fund a cache of available bullets in the game. In this example, the CEE is the bullets available to the players. The cache is distributed throughout the geography of the game, in various locations and amounts (for example, ten bullets might be hidden under the floor boards of an abandoned home and 100 bullets might be found in a weapons depot elsewhere in the game world). Players each start with a minimum number of bullets (e.g. 10), and all other RC they contribute (which may or may not be the same amount for each player) is used to fund the CEE. As the game progresses, individual players seek to find CEE and it is then added to their individual EE. Each time they fire their weapon subsequently, EE is consumed, a gambling game is triggered, and the resulting outcome of the gambling game causes an appropriate increment or decrement to the individual player's EE.

The process described in the previous paragraph may cause RC to be drawn to the player at the same time the CEE is collected (and the individual's EE incremented), or the RC can be drawn down from a collective account at the time the EE is consumed and the gambling game is initiated. Note also that the same logical constructs may apply to CAE, AE and the accumulation v. consumption of EE as may be appropriate in the specific game context, etc.

In this way, the CEE concept (and its CAE analog) represents a means by which players compete over a pool of finite resources to which each participant has contributed at the onset of the game or throughout. It is not required that each player provide an equal amount of RC (and by extension CEE or CAE) to the game. Varying amounts may be contributed as a function of various factors, including player skill, casino promotion, or player choice, for example.

In some embodiments, in the event that players are able to contribute unequal amounts of RC (and by extension CEE and/or CAE) to the game, one of a number of leveling mechanisms can be instituted within the game construct (though this is not required), regardless of whether game play is fundamentally cooperative or competitive. Leveling can take one or more of the following forms (this being a non-exhaustive list of various embodiments):

In some embodiments, players may acquire GWC at varying rates as a function of their relative or absolute RC contributions. This function is applicable to single player games as well.

In various embodiments, players may gain benefits or experience disadvantages in the context of the entertainment game as a function of the amount of RC contributed in an absolute sense or relative to other players. This function is applicable to single player games as well.

In numerous embodiments, a tax (RC, EE, AE, CEE, CAE or any combination) may be collected from players contributing lower amounts of RC. This tax may be kept by the house and/or distributed to players contributing higher amounts of RC. The tax may be collected at the time funds are contributed to the game, or over time as a function of player actions and/or game play.

In some embodiments, players contributing a greater amount of RC may benefit from the gambling wins of other players through a "commission" i.e. they are presumed to be subsidizing the gambling of other players and gain financially when the subsidized player wins.

In many embodiments, at the completion of game play, RC may be distributed on a "greatest contributor to least contributor" basis, with each player (beginning with the one who contributed the most) getting back their original contribution, and then winnings distributed subsequently to the extent that any remain (and taking into account any portion taken by the house, said amount being taken first, last or at intervals in-between depending upon casino driven settings). Winnings could also be distributed in proportion to the amount initially contributed, or could be distributed to the player(s) whose in-game action(s) triggered the winning bet(s), or by some other method.

In some embodiments, the RC contributed to the game remains tied to the contributing player in all cases, even if a different player draws the CEE to his in-game character and consumes it (or undertakes the equivalent in a CAE context). In this way, the gambling games triggered by a second player can in fact cause changes in the RC account associated with the first player (that player having knowingly committed these funds to a game with this feature). For example, in a shooter game, player A contributes 100 RC and player B contributes 10 RC. This corresponds to 100 and 10 bullets respectively (the EE). Player B finds a cache of fifty bullets. The first ten are imputed to relate to his own RC, but the remaining forty read upon the RC of player A. When player B fires bullets number 11-50, the RC resultant of the gambling games accrues to the RC account of player A and not player B, though any EE accumulated as a result in RC wins in the gambling game accrue to player B.

In many embodiments, gambling games triggered by a second player would use the amounts, wagering odds, and/or other options selected by the first player.

In numerous embodiments, gambling games triggered by a second player would use the amounts, wagering odds, and/or other options selected by the second player.

In various embodiments, RC gains as a result of a second player causing funds initially committed to the game by a first player to be gambled are divided between the second and first player based upon an algorithm established by the casino, the players themselves, or a combination of both, said algorithm having been clearly communicated to the players prior to the commitment of funds to the game.

Figure 2:
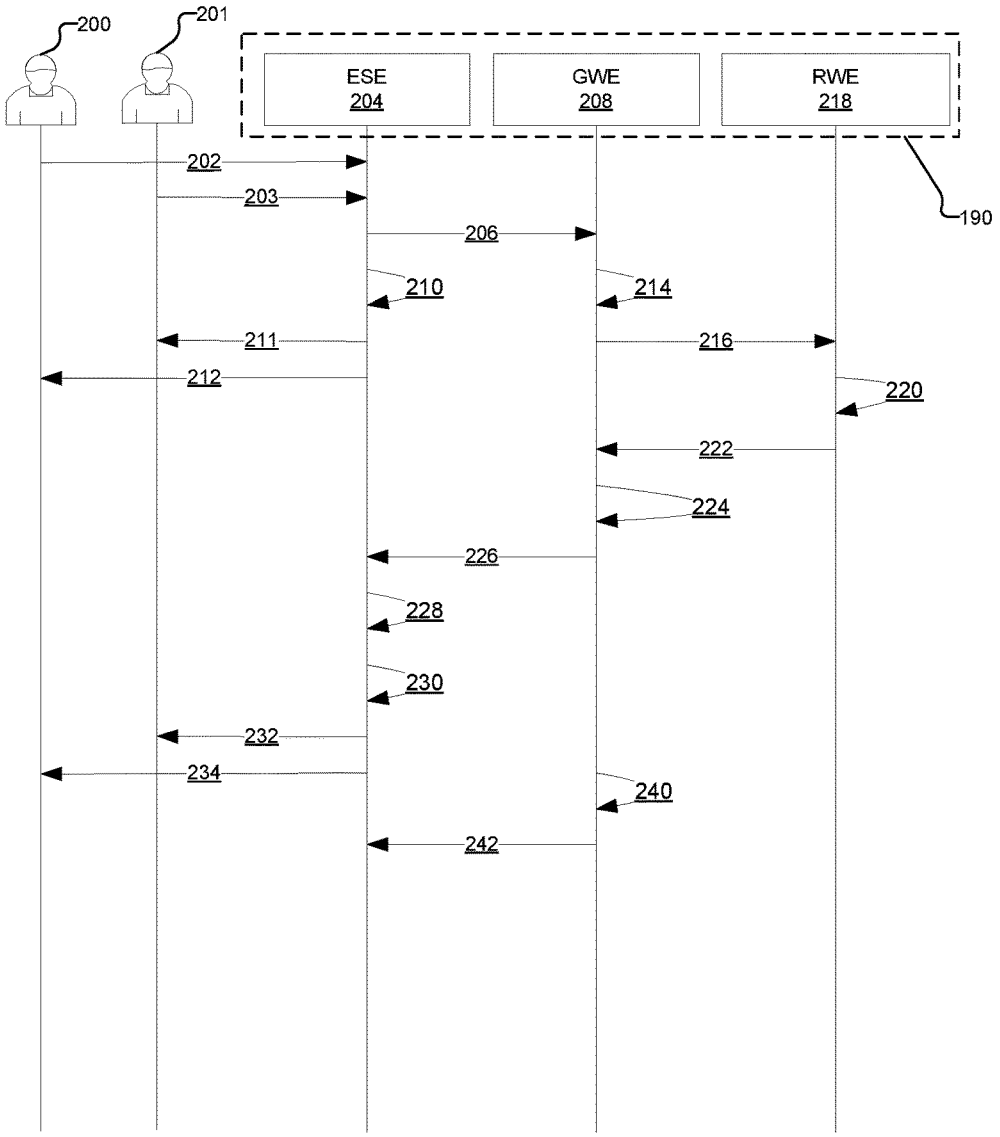
FIG. 2 is a diagram of a sequence of operations in a process in accordance with exemplary embodiments.

In some embodiments, the management of CEE or CAE may be handled by a single hybrid game or managed across multiple hybrid games. In the former case, multiple player interactions, through a single game with user interfaces for each player, or across multiple terminals, can be supported. In the latter case, mechanisms similar to those utilized for multiple player online games or massively multiple player online games can be deployed to support the management of CEE, CAE, elements of real world game play, elements of game world game play, RC, GWC, Referring now to FIG. 2, FIG. 2 is a diagram of a sequence of operations in accordance with exemplary embodiments. During operation of numerous embodiments of a hybrid game 190, player, such as player 200 or 201, interacts (202 and 203, respectively) with game world elements (such as CEEs or CAEs as described herein) associated within interactive entertainment game hosted by an ESE 204 via a user interface (not shown). The ESE receives the user interactions and sends (206) them to a GWE 208 as player actions within the context of the interactive entertainment game of the ESE. The ESE 204 also uses the player actions to update a game state of the game being played by the players and generate (210) a portion of the entertainment game for respective game presentations (211 and 212) to the players 201 and 200.

The GWE 208 determines (214) from the player interactions with the entertainment game elements as represented by the player actions, whether or not a gambling game should be initiated or triggered on an RWE 218. The determination may be made, and the type of wager, may be accomplished using any of the procedures as described herein. If a gambling game is to be triggered, the GWE triggers (216) a gambling game on the RWE. The RWE executes (220) the gambling game allocating an amount of contribution of amounts of RC for the wager from each of the players as described herein and using an RNG and tables or the like to generate a gambling outcome 222. The RWE sends the gambling outcome to the GWE. In addition, the RWE increments and/or decrements player 200 and/or 201 RC accounts based on the gambling outcome using any of the distribution processes as described herein.

The GWE 208 determines (224) from the gambling outcome whether or not the player's respective GWC and/or elements of the interactive entertainment game should be updated to reflect the gambling outcome. If elements of the entertainment game are to be updated, the GWE sends element updates 226 to the ESE 204. The ESE uses the element updates from the GWE to update (228) the game state of the game being played by the players 200 and 201, and generate (230) additional presentations, 232 and 234, for the players to reflect the elements that were updated at the request of the GWE and presents the updated presentations to the players 200 and 201. Furthermore, the GWE distributes (240) any GWC changes 242, such as increments or decrements, to each of the players, as determined by any of the processes described herein.

In various embodiments, the hybrid game includes one or more CEE commodity element types, with each CEE type accreted to by a plurality of players of the game. Each CEE type may further be accreted to by one or more of the following as a function of each player of the entertainment/skill game: (a) game character actions within the game context, (b) accumulation of the CEE commodity in the game, and (c) a percentage of RC won in the RWE wagering portion of the game.

In numerous embodiments, each CEE type being consumed according to one or more of the following: (a) game character actions within the game context, (b) use of the CEE commodity in the game, and (c) a percentage of RC lost in the RWE wagering portion of the game.

In some embodiments, a hybrid game includes the logic and systems to initiate wagers of varying types and amounts, based on the consumption of one or a plurality of CEE types.

In various embodiments, the hybrid game includes CAE, of one or more types, and the CAE transpiring causes a wager of a certain amount of RC in a type of wagering proposition.

In some embodiments, individual players consume CEE, and the results of which accrue to individual player's RC and shared CEE.

In numerous embodiments, individual players consume CEE, and the results of which accrue to a group of player's RC and shared CEE.

In various embodiments, players consume CEE jointly, and the results accrue to individual player's RC and shared CEE.

In some embodiments, players consume CEE jointly, and the results accrue to a group's player's RC and shared CEE.

In numerous embodiments, a process controlling the rate at which results accrue to a group's or individual player's RC and shared CEE utilizes one or more of the following inputs as to the amount of: (a) RC, (b) EE, (c) GWC, and (d) other variable associated with a specific player as set at the onset of or during game play.

In some embodiments, a process controlling the rate at which results accrue to a group's or individual player's RC and shared CEE utilizes one or more of the following inputs as to the amount of: (a) RC, (b) EE, (c) GWC, and (d) other variable associated with a specific player that is contributed by each player or the group at the onset of or during game play.

In numerous embodiments, a hybrid game supports sharing of various types of CEE and/or CAE and any resultant changes in RC can take place at varying rates.

In various embodiments, any of the aspects of a hybrid game that affects EE or AE, its relationship with RC, and another other EE or AE influencing and outcome effects may be applied in the same manner to CEE.

In some embodiments, players can contribute dissimilar amounts of RC to a hybrid game, and by extension CAE or CEE.

In numerous embodiments, players can consume/collect/initiate CEE and/or CAE at varying rates and draw RC to themselves in amounts that exceed the amount of RC that the player has committed to the game.

In various embodiments, leveling mechanisms are used to reflect unequal contributions of RC to the hybrid game by the players.

In some embodiments, RC previously contributed to the hybrid game by one or more players is allocated to individual players as a function of their acquisition and/or consumption and/or initiation of CEE and/or CAE.

In numerous embodiments, RC is acquired by a player as a function of a gambling game result is distributed according to a process based on a range of parameters, including the contributing party, the gambling party, the casino's take, and other factors.

As illustrated in FIG. 1 and FIG. 2, only two players are shown. It should be understood that any of the collective element processes as described herein may be implemented using any number of players sharing a collective element.

Figure 3:
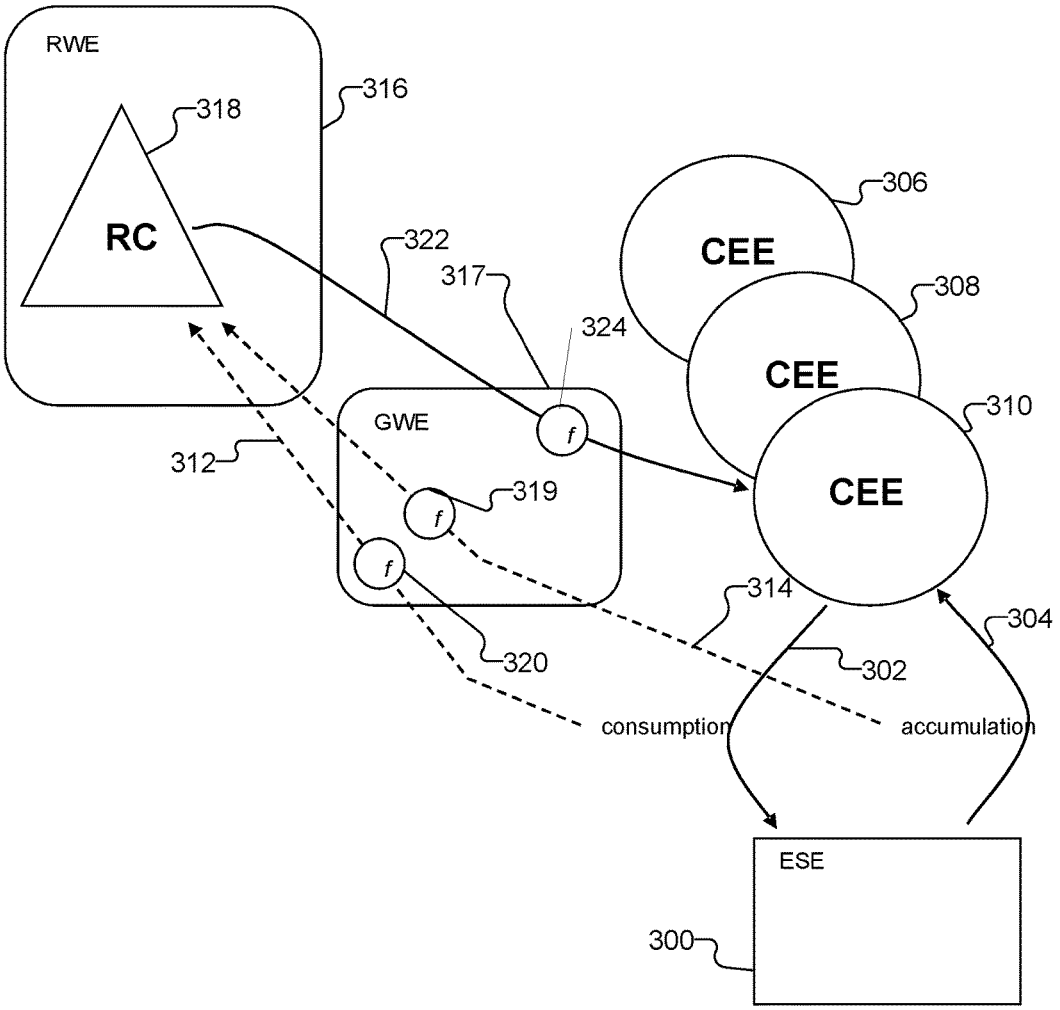
FIG. 3 is a diagram of a process of using collective enabling elements in accordance with exemplary embodiments.

FIG. 3 illustrates the relationship between one or more CEEs and RC within a hybrid game. One or more CEEs, such as CEEs 306, 308 and 310, can accumulate or be consumed within a hybrid game. Relationships with RC 318 as generated, maintained and consumed by an RWE 316, such as a consumption relationship 312, an accumulation relationship 314 and relationship 322 are defined in one or the other direction by a series of functions, such as functions 319, 320 and 324 that may reside within a GWE 317. Consumption of a CEE causes a function-specified amount of RC to be committed to a gambling proposition, subject to processes implemented by the functions in the GWE. The result of which may cause the accumulation of RC, and this, in turn causes a function-specific amount of CEE to be accumulated.

FIG. 3 illustrates the case where multiple players interact with one or more CEEs, such as CEEs 306, 308 and 310, through a single hybrid game. According to some embodiments, an implementation of a hybrid game may span multiple instances of hybrid games, where the elements shown could span the multiple instances of hybrid games, and be accessed by more than one GWE, ESE, RWE, etc. This same effect (i.e. the distribution of the logical elements that enable the use of CEE and/or CAE) applies to FIG. 4 as well.

Figure 4:
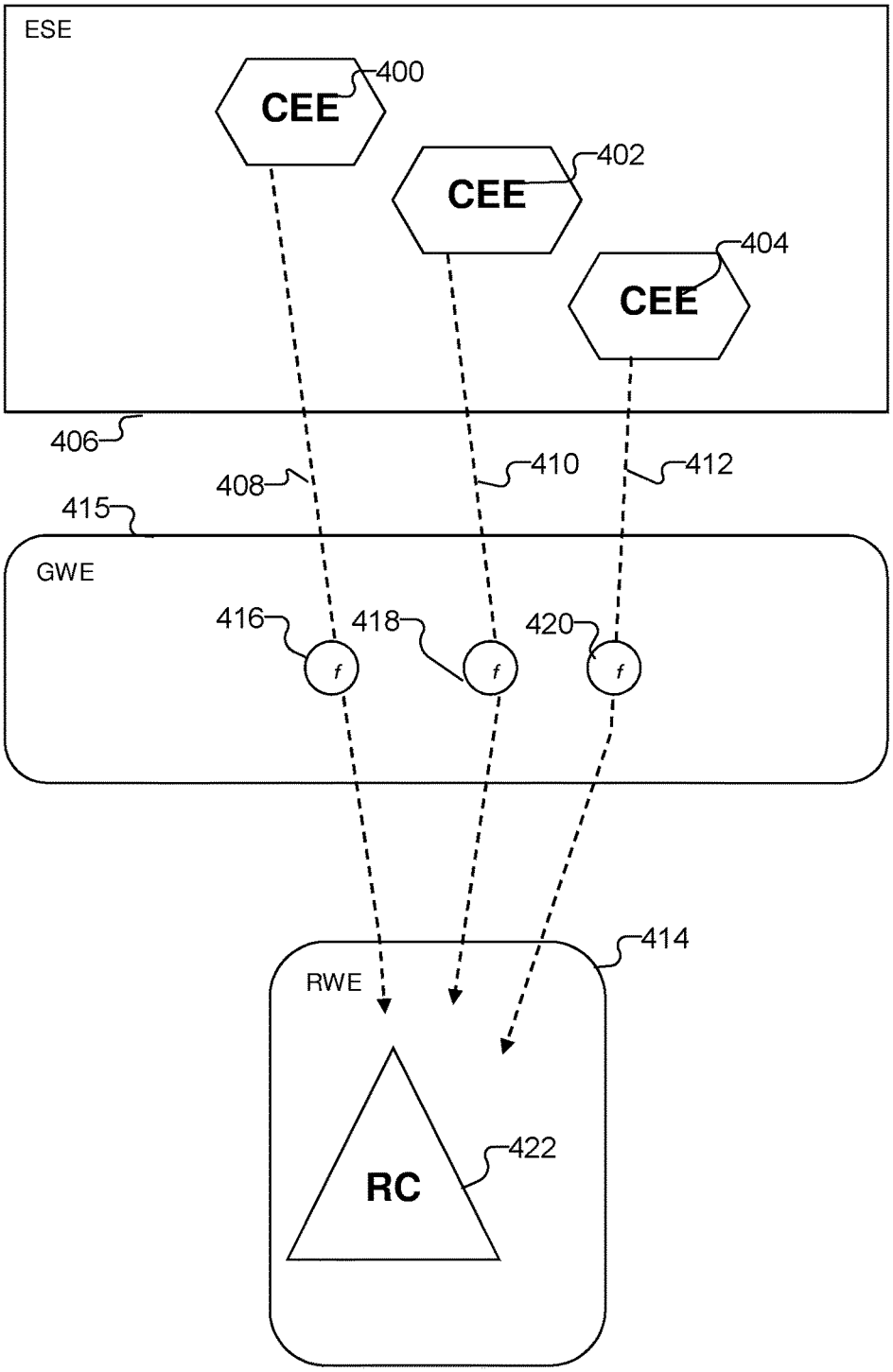
FIG. 4 is a diagram of another process of using collective enabling elements in accordance with exemplary embodiments.

In FIG. 4, CEEs, such as CEE 400, 402 and 404, within an ESE 406 entertainment/skill game are shown. In the figure, when a CEE is consumed, a trigger, such as trigger 408, 410 or 412, of an RWE-based gambling game associated with RWE 414 results, the occurrence of which and the size and nature of the wager being controlled by functions, such as functions 416, 418 and 420, implementing various processes as described herein operating in a GWE 415. As seen in the figure, there may be one, none or more CEEs operating in the hybrid game construct. Since the nature of the correlation of a CEE to RC 422 is under control of the GWE, the relationship between them may be linear or non-linear, and may vary based on what play level the game is operating at, the amount of time that game has been play, the amount of GWC a player has, and a number of other possible factors. In some embodiments, and as illustrated in FIG. 4, the relationship is that of CEE causing RWE action and thus impact to the RC, and is not a bi-directional relationship. This is to say that the accumulation of RC, through winning the gambling game or putting additional credits in the machine does not affect CEE. The relationship between CEE and RC is causal from the direction of CEE to RC, that is the consumption of CEE event initiates the execution of a gambling game with a specified amount of RC.

Figure 5:
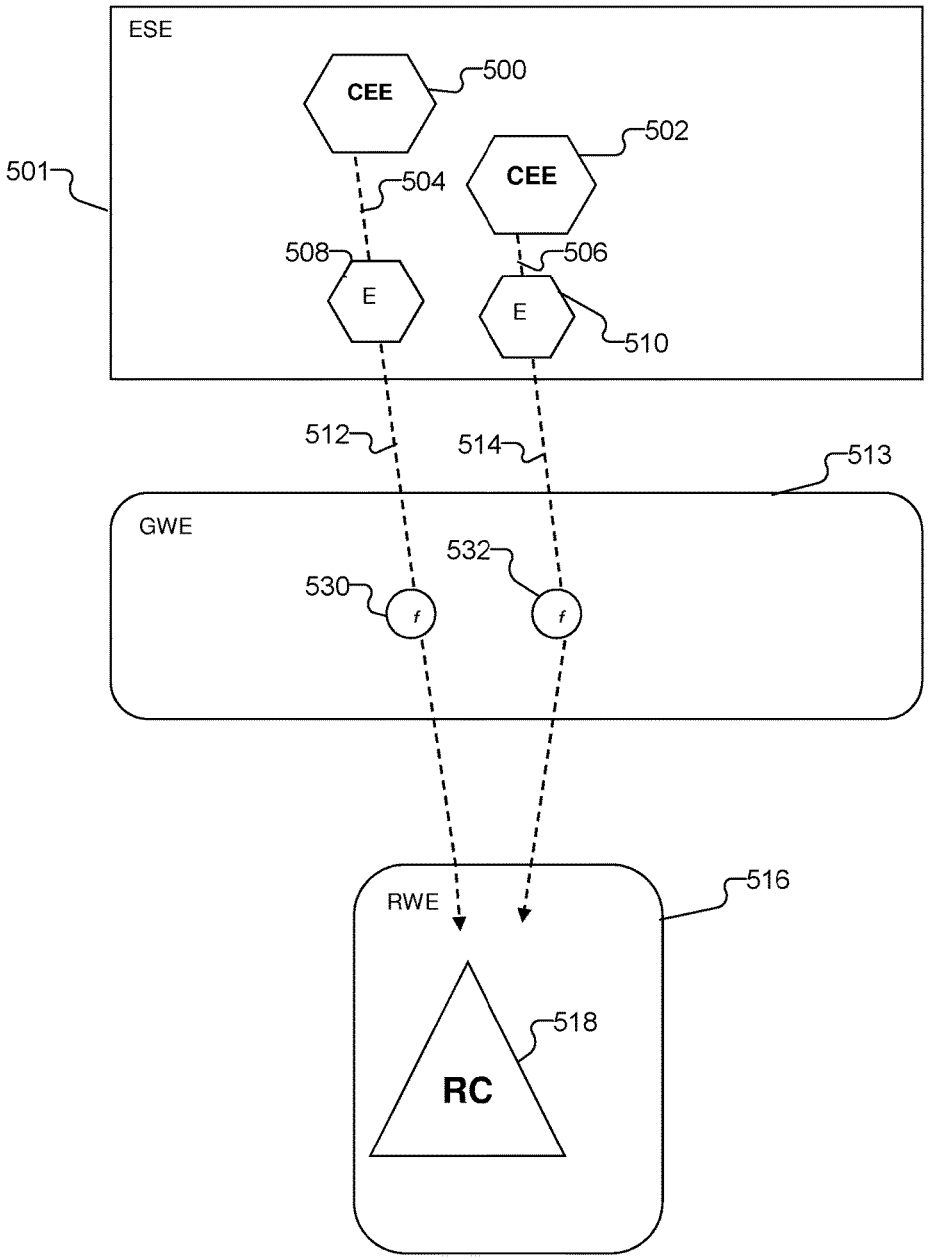
FIG. 5 is a diagram of another process of using collective elements in accordance with exemplary embodiments.

FIG. 5 illustrates another process of a hybrid game in accordance with exemplary embodiments. In FIG. 5, one or more forms of CEE, as exemplified by CEE 500 and CEE 502, associated with an ESE 501 included in a hybrid game are converted (504 and 506) into an individual player's respective EE, such as EE 508 and EE 510 when the player collects CEE 500 and 502, respectively, and it is the subsequent consumption of EE 508 or 510, respectively, (which may be delayed in time) that triggers (512 or 514, respectively) a gambling game associated with an RWE 516 where the outcome of the gambling game is reflected in an amount of RC 518. The parameters of the gambling game may be, such as the occurrence of which and the size and nature of which may be controlled by functions, such as function 530 or 532 included in GWE 513, implementing the various processes as described herein.

Figure 6:
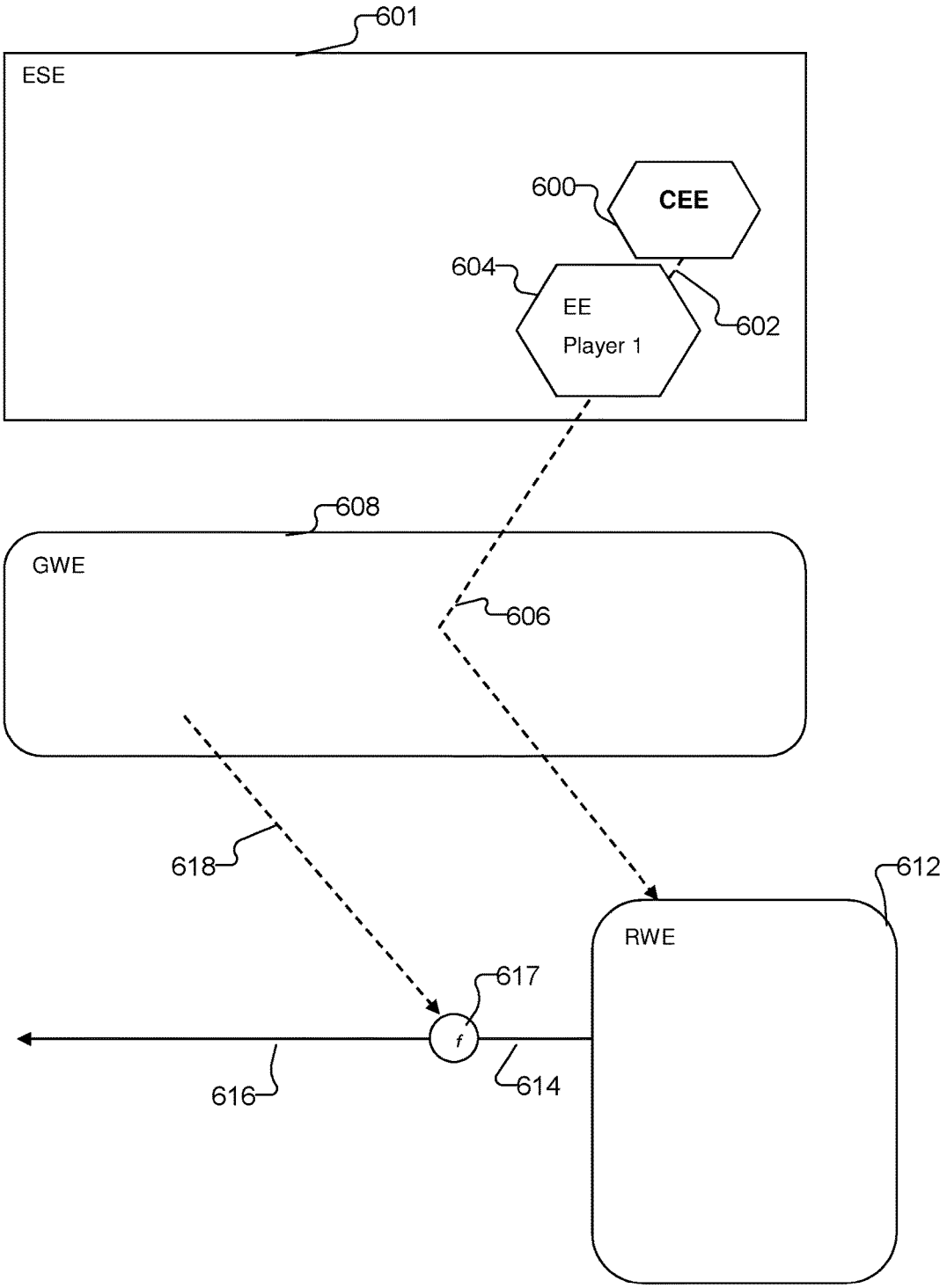
FIG. 6 is a diagram of another process of using collective elements in accordance with exemplary embodiments.

FIG. 6 is a process flow diagram of another process in accordance an exemplary embodiment. In FIG. 6, a player (Player 1) collects CEE 600 associated with ESE 601, at which time CEE 600 is connected (602) to Player 1 in the form of player specific EE 604. When Player 1, via EE 604, initiates (606) a gambling game via GWE 608, one of a variety of forms of RC associated with RWE 612 may be consumed. Various embodiments include RC contributed directly by Player 1, communal RC, RC associated with one or more specific players but not Player 1, etc. as described herein. This is represented by the generic notation, "RC Player N". If the gambling game results in an increase (614) in RC, this RC is distributed (616) by a function 617 associated (618) to one or more player's accounts by a predefined process implemented by the function and as described herein.

Figure 7:
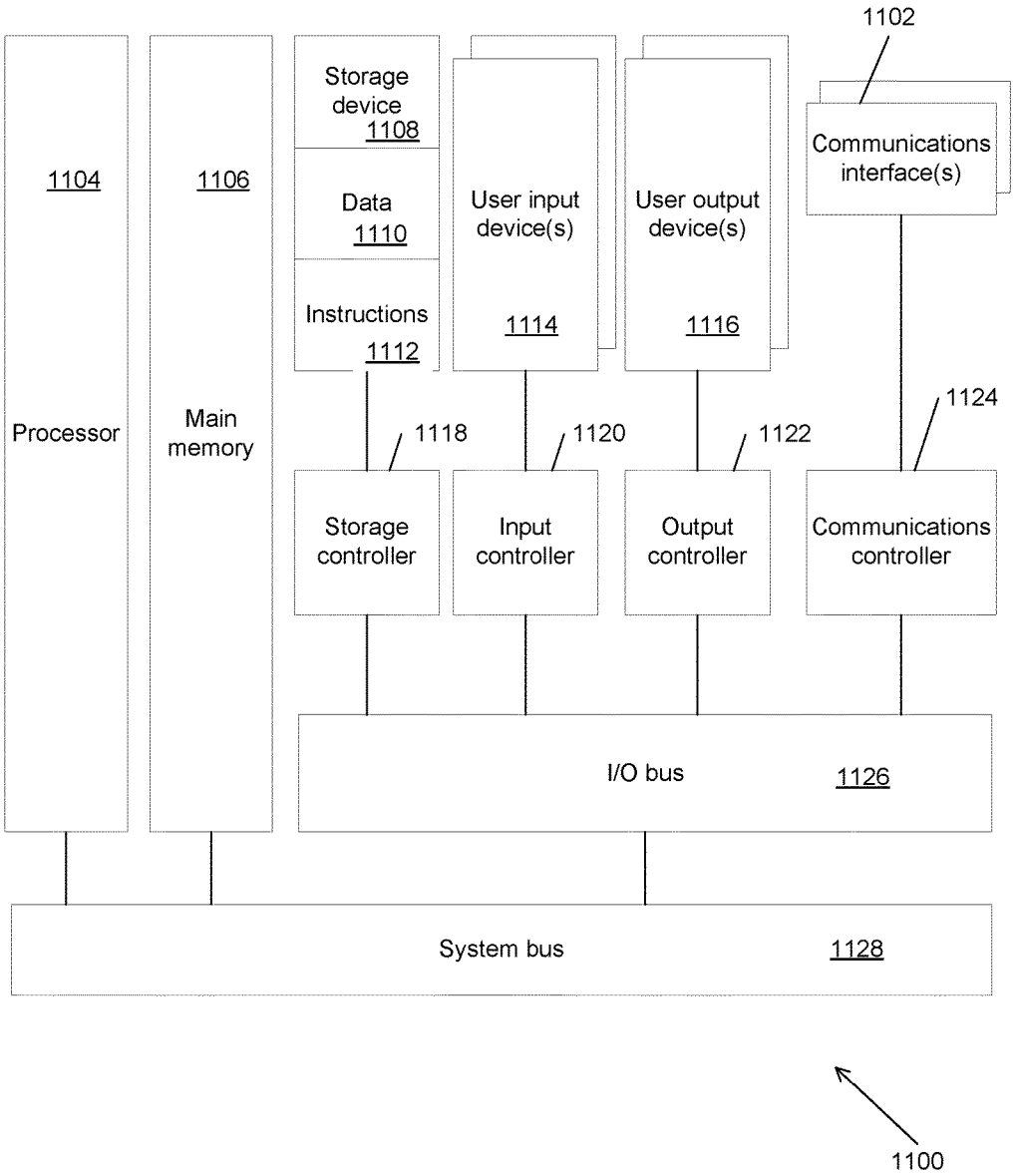
FIG. 7 is a hardware architecture diagram of a processing apparatus in accordance with exemplary embodiments.

FIG. 7 is a hardware architecture diagram of a processing apparatus in accordance with exemplary embodiments. Any of a variety of processing apparatuses can host various components of a hybrid gaming system in accordance with various embodiments of the invention. In several embodiments, these processing apparatuses can include, but are not limited to, a game console, a gaming machine, a general purpose computer, a computing device and/or a controller. In the processing apparatus 1100, a processor 1104 is coupled to a memory 1106 by a bus 1128. The processor 1104 is also coupled to non-transitory processor-readable storage media, such as a storage device 1108 that stores processor-executable instructions 1112 and data 1110 through the system bus 1128 to an I/O bus 1126 through a storage controller 1118. The processor 1104 is also coupled to one or more interfaces that may be used to connect the processor to other processing apparatuses as well as networks as described herein. The processor 1104 is also coupled via the bus to user input devices 1114, such as tactile devices like keyboards, keypads, foot pads, touch screens, trackballs, etc., as well as non-contact devices such as audio input devices, motion sensors and motion capture devices, etc. that the processing apparatus may use to receive inputs from a user when the user interacts with the processing apparatus. The processor 1104 is connected to these user input devices 1114 through the system bus 1128, to the I/O bus 1126 and through the input controller 1120. The processor 1104 is also coupled via the bus to user output devices 1116 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 1128 to the I/O bus 1126 and through the output controller 1122. The processor 1104 can also be connected to a communications interface 1102 from the system bus 1128 to the I/O bus 1126 through a communications controller 1124.

In various embodiments, a processor loads the instructions and the data from the storage device into the memory and executes the instructions and operates on the data to implement the various aspects and features of the components of a hybrid gaming system as described herein. The processor uses the user input devices and the user output devices in accordance with the instructions and the data in order to create and operate user interfaces for players, casino operators, owners, etc. as described herein.

Although the processing apparatus is described herein as being constructed from a processor and instructions stored and executed by hardware components, the processing apparatus can be composed of only hardware components in accordance with many embodiments. In addition, although the storage device is described as being coupled to the processor through a bus, those skilled in the art of processing apparatuses will understand that the storage device can include removable media such as a USB memory device, an optical CD ROM, magnetic media such as tape or disks, etc. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any of portion of a hybrid game including, an RWE, a GWE and an ESE, as described herein can be implemented on one or more processing apparatuses, whether dedicated, shared or distributed in any combination thereof, or may be implemented on a single processing apparatus. Furthermore, it should be understood that the various processing apparatuses implementing the features of a hybrid gaming system may be distributed within a communications network, such as a local area network, wide area network, the Internet, or the like. In addition, while certain aspects and features of a hybrid gaming system described herein have been attributed to an RWE, a GWE or an ESE, these aspects and features may be implemented in a hybrid form where any of the features or aspects may be performed by any of a RWE, a GWE or an ESE within a gaming system without deviating from the spirit of the invention.

While the above description contains many specific embodiments of the invention, these should not be construed as limitations on the scope of the invention, but rather as examples of embodiments thereof. It is therefore to be understood that the invention may be practiced otherwise than as specifically described, without departing from the scope and spirit of the invention. Thus, the described embodiments of the invention should be considered in all respects as illustrative and not restrictive.

What is claimed:

1. An electronic gambling game machine for processing a collective bet in a hybrid game having a computer entertainment video game and a gambling game, the electronic gambling game machine comprising:

a real world controller connected to a game world controller, the real world controller comprising:

a credit meter;

a random number generator; and a credit paytable, wherein the real world controller is constructed to:

receive credit;

receive, from the game world controller, wager parameters;

receive, from the game world controller, a wager trigger; and determine a gambling outcome for a wager of credit using the random number generator, the wager parameters, and the credit paytable in accordance with a gambling proposition of the gambling game using the trigger;

an entertainment software controller connected to the game world controller by a network, the entertainment software controller constructed to:

provide the computer entertainment video game, wherein the computer entertainment video game is a multi-player cooperative skill based entertainment video game, played by a plurality of players;

receive player input from one or more of the plurality of players for the multi-player cooperative skill based entertainment video game;

determine accumulation of a collective element of the multi-player cooperative skill based entertainment video game resulting from the player input from the one or more of the plurality of players, wherein the collective element is available for use by the plurality of players of the skill based entertainment video game during play of the multi-player cooperative skill based entertainment video game;

distribute, to the game world controller, the actions taken by the plurality of players in the context of the multi-player cooperative skill based entertainment video game;

receive, from the game world controller, the gambling outcome;

receive, from the game world controller, an update of the state of the multi-player cooperative skill based entertainment video game;

generate a visual display of the multi-player cooperative skill based entertainment video game, wherein the visual display includes the available collective elements and the gambling outcome;

a user input device constructed to receive, from the one or more of the plurality of players, a selection of an icon on the display to initiate use of the available collective elements; and update a state of the multi-player cooperative skill based entertainment video game;

the game world controller connected to the real world controller and the entertainment software controller, wherein the game world controller is constructed to:

distribute, to the entertainment software controller, the available collective elements to be presented to the one or more of the plurality of players;

receive, from the entertainment software controller, player input from the one or more of the plurality of players for the multi-player cooperative skill based entertainment video game;

receive, from the entertainment software controller, game state data for the multi-player cooperative skill based entertainment video game;

correlate parameters of the wager of credits based on a game state of the multi-player cooperative skill based entertainment video game;

distribute the parameters of the wager of credits to the real world controller;

trigger the wager of credits in the real world controller based on the accumulation of the collective element of the skill based entertainment video game;

distribute to the entertainment software controller, the gambling outcome generated by the real world controller; and determine the update of the game state of the multi-player cooperative skill based entertainment video game based on the payout of the gambling outcome; and distribute to the entertainment software controller the update of the state of the multi-player cooperative skill based entertainment video game.

2. The electronic gambling game machine of claim 1, wherein the network is a local area network.

3. The electronic gambling game machine of claim 1, wherein the accumulation of the collective element includes accumulation of a collective enabling element, wherein the collective enabling element is an element of the multi-player cooperative skill based entertainment video game used by one or more of the plurality of players during play of the skill based entertainment video game, and wherein the game world controller is further constructed to:

determine use of the collective enabling element by the one or more of the plurality of players; and distribute, to the real world controller, a trigger of the gambling game based on the use of the collective enabling element.

4. The electronic gambling game machine of claim 1, wherein the accumulation of the collective element includes accumulation of a collective actionable element, wherein the collective actionable element is an element of the multi-player cooperative skill based entertainment video game acted upon by one or more of the plurality of players during play of the skill based entertainment video game, and wherein the game world controller is further constructed to:

determine that the collective actionable element was acted upon by the one or more of the plurality of players; and distribute, to the real world controller, a trigger of the gambling game based on the action upon the collective actionable element of the multi-player cooperative skill based entertainment video game.

5. The electronic gambling game machine of claim 1, wherein an amount of a wager made in the gambling game is allocated from each of the plurality of players based on each player's use of the collective element.

6. The electronic gambling game machine of claim 1 wherein the credit is a currency fungible instrument.

7. The electronic gambling game machine of claim 1 wherein the credit is a game world credit.

8. The electronic gambling game machine of claim 1, wherein the game world controller and the real world controller are constructed from the same device.

* * * * *